United States Patent [19]

Salvarezza

[11] Patent Number: 4,655,321

[45] Date of Patent: Apr. 7, 1987

[54] ROPE LADDER WITH MOLDED HARD ELASTOMER STEPS AND METHOD FOR ASSEMBLYING THE LADDER THEREFOR

[76] Inventor: Robert M. Salvarezza, 110 Braemar Dr., Hillsborough, Calif. 94010

[21] Appl. No.: 902,185

[22] Filed: Aug. 29, 1986

[51] Int. Cl.[4] ..... E06C 1/56

[52] U.S. Cl. ..... 182/196; 181/46; 181/228

[58] Field of Search ..... 182/46, 196, 197, 198, 182/228, 199

[56] References Cited

U.S. PATENT DOCUMENTS

| | | | |
|---|---|---|---|
| 3,415,341 | 12/1968 | Hostetler | 182/198 |
| 4,177,878 | 12/1979 | Salvarezza | 182/199 |
| 4,241,809 | 12/1980 | Salvarezza | 182/199 |
| 4,442,920 | 4/1984 | Gronbeck | 182/46 |
| 4,554,996 | 11/1985 | Salvarezza | 182/199 |

FOREIGN PATENT DOCUMENTS

| | | | |
|---|---|---|---|
| 133386 | 10/1951 | Sweden | 182/199 |

*Primary Examiner*—Reinaldo P. Machado
*Attorney, Agent, or Firm*—Owen, Wickersham & Erickson

[57] ABSTRACT

A rope ladder of the type having a series of ladder steps and two spaced-apart pairs of ropes. Each step has a metal step frame about which is molded a hard elastomer body. Each step has a rope-receiving opening therethrough shaped and sized for closely confining a pair of ropes. Each step has a pair of horizontal transverse openings therethrough parallel to each other on each side of each rope-receiving opening. Before molding, nylon tubes are inserted in each end of each transverse opening and held during molding by slug bolts. After molding, the steps are each cut, on one side only, to provide a main step portion and two separate gripping portions, one for each rope-receiving opening, and each incorporating a portion of the frame and a portion of the body, the gripping portions including a portion of each transverse opening. A bolt is inserted through each pair of aligned nylong tubes, extending through both the main step portion and each gripping portion. A nut is loosely placed on each bolt. The ropes are then threaded through the through openings of the steps. The nuts of the bottom step are tightened. Then the ropes are placed in tension and that step tested. Next the nuts are fully tightened for clamping each gripping portion to the main step portions of all the other steps, to clamp the ropes in each rope-receiving opening. Finally, the tension on the ropes is released.

13 Claims, 14 Drawing Figures

FIG. 1
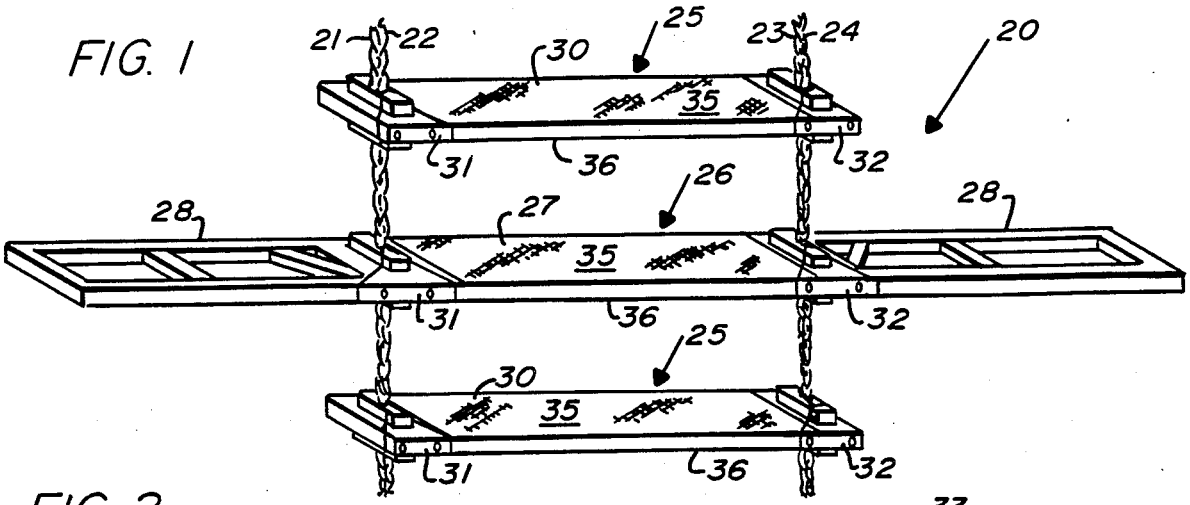
FIG. 2
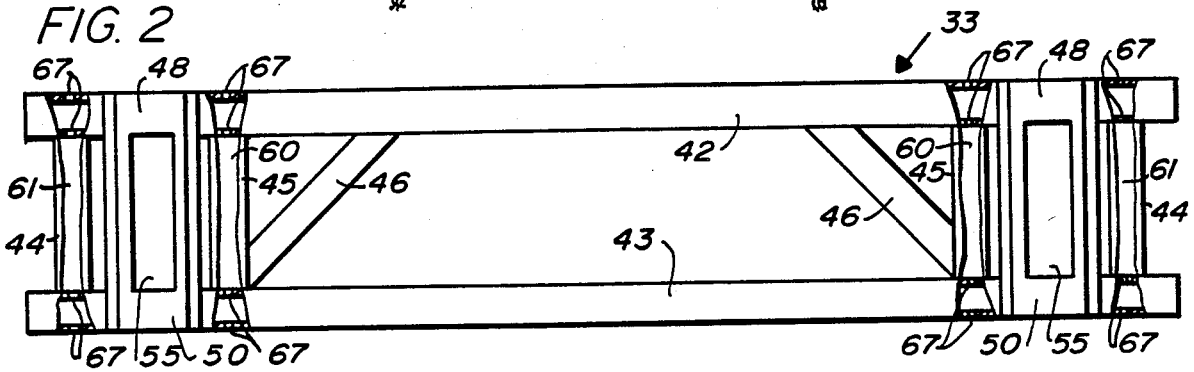
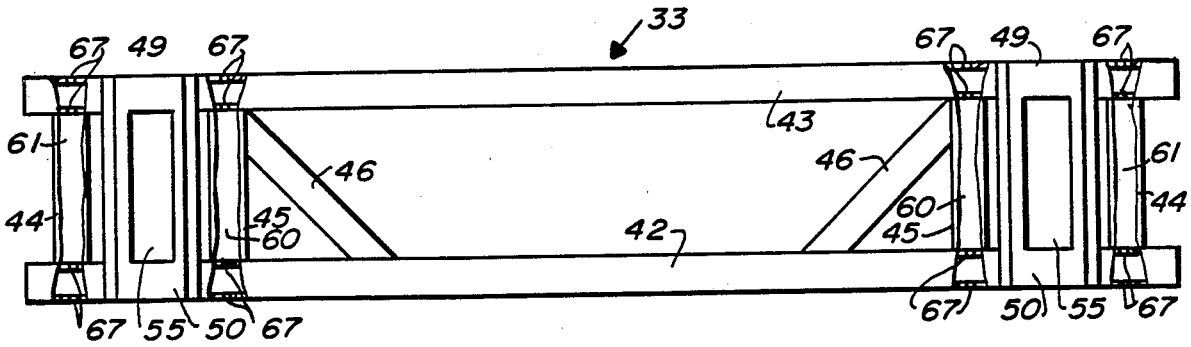
FIG. 3
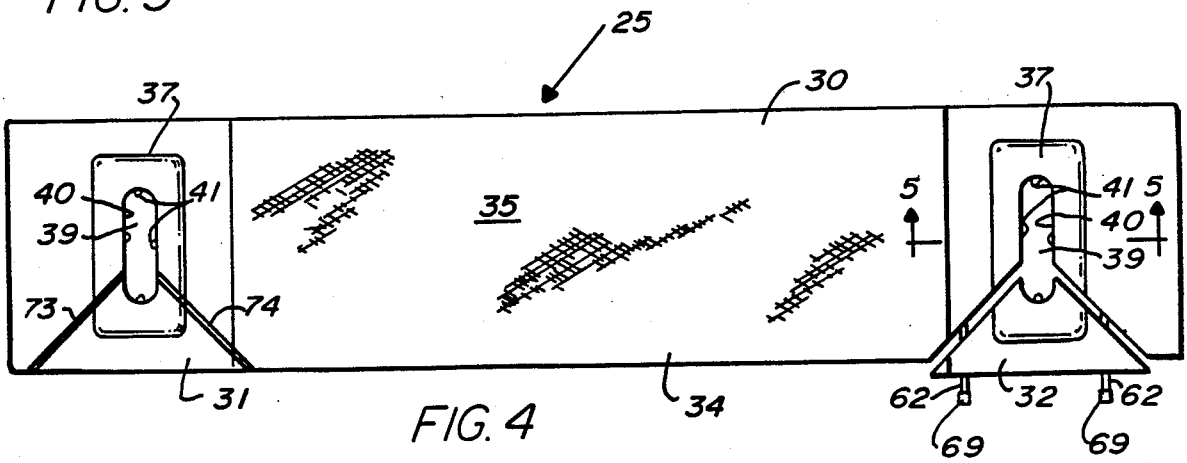
FIG. 4

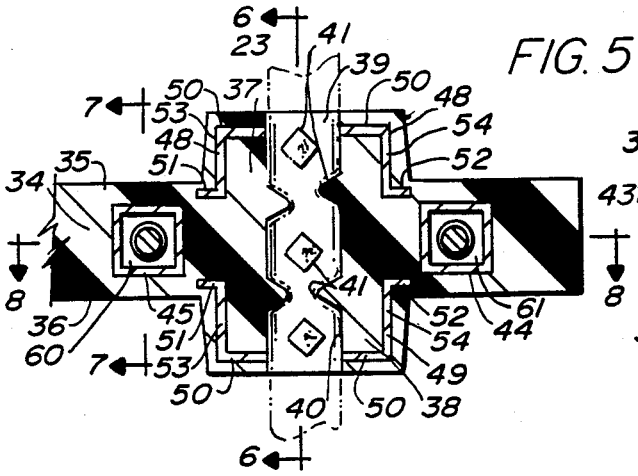
FIG. 5
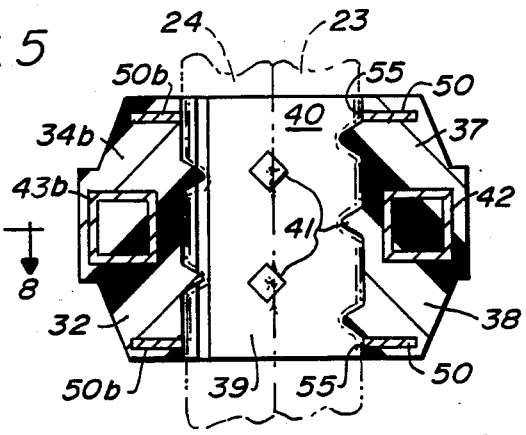
FIG. 6
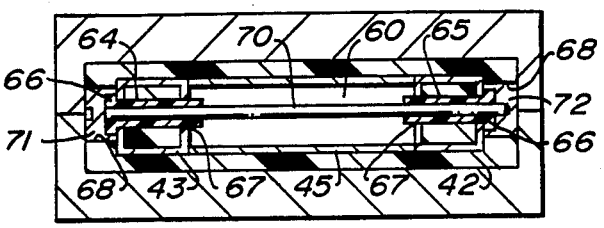
FIG. 7
FIG. 8
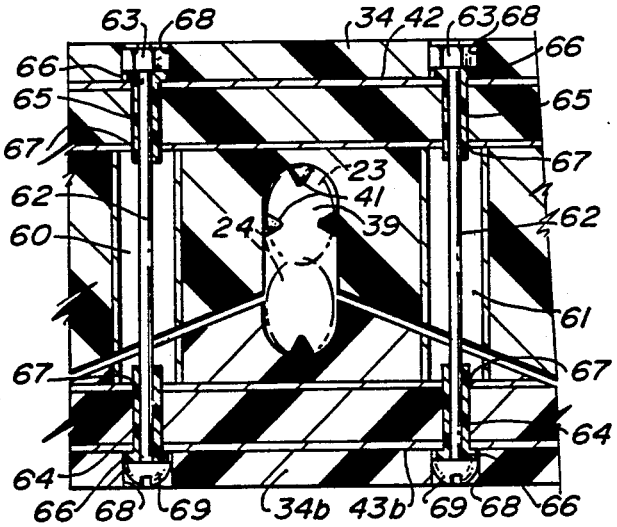
FIG. 13
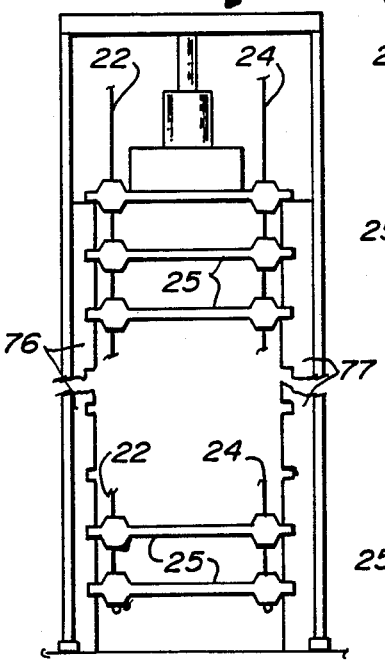
FIG. 14
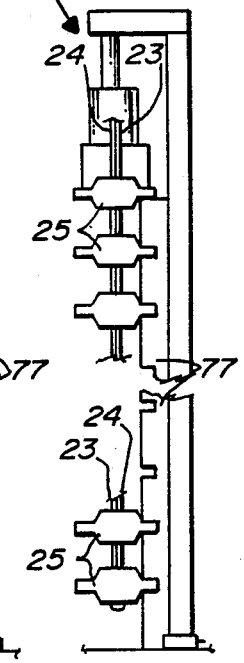
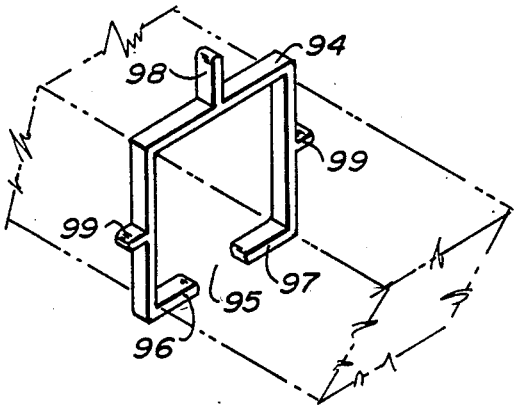
FIG. 10

ROPE LADDER WITH MOLDED HARD ELASTOMER STEPS AND METHOD FOR ASSEMBLYING THE LADDER THEREFOR

The present invention relates to improvements in rope ladders, regular steps and spreader steps therefor, to a method for molding the spreader steps, and to a method for assembling the ladder.

BACKGROUND OF THE INVENTION

The invention relates to a rope ladder of the type in which there are two ropes on each side of an improved molded step. The principal problems are how to secure the steps to the ropes and how to shorten the time and lower the costs of assembly of the ladder.

In ladders such as that shown in U.S. Pat. No. 4,420,920, a bolt secured to the step goes in between the braids of the ropes. This structure involves such safety risks that such ladders are no longer approved by the U.S. Navy. The ladder in that patent also employs separate notches and a clamping system that calls for each notch to be open at one end, leaving only a thin isthmus of the step to carry the load.

An object of the invention is to provide an improved, safe, rope ladder employing horizontal bolts. Other objects and advantages of the invention will appear from the following description.

SUMMARY OF THE INVENTION

The rope ladder of this invention has a series of ladder steps and two spaced-apart pairs of ropes. Each step includes a metal step frame with a pair of longitudinal members joined by shorter crossing members. At each end of the frame a pair of aligned metal brackets bridge across the pair of longitudinal members, one on their upper surface and one on their lower surface. Each bracket has generally vertical portions leading to a generally horizontal plate which defines a generally rectangular opening. The openings of the two plates are aligned with each other. A hard elastomer body is molded around the frame, providing the step tread and at each end thereof a pair of collar portions, each molded around one of the brackets and each providing a rope-receiving opening extending through the collar portions and the body in between them, this opening being in line with the rectangular openings through the brackets. Each rope-receiving opening is shaped to generally uniform dimensions all the way through and is sized for closely confining one pair of ropes. Moreover, the body is molded to provide rope-engaging projections extending into each of these openings and engaging the ropes.

The step is provided, preferably during molding, with a pair of horizontal transverse bolt openings parallel to each other on each side of each of the rope-receiving openings. The bolt openings extend transversely through the longitudinal members. Preferably, these bolt openings include molded-in nylon tubes that later insulate the bolts, which are preferably stainless steel, from the frame of a lightweight steel alloy.

When the step has been made, cuts are made on one side only to provide a main step portion and two separate gripping portions, one for each rope-receiving opening. Each gripping portion incorporates a portion of one longitudinal frame member, a portion of the upper and lower plate portions and a portion of the body. The gripping portions also include a portion of each of the two transverse bolt openings. Preferably, each step is then partially assembled by placing a bolt through each bolt opening (through the nylon tubes) of both the main step portion and the gripping portions and placing a nut or other fastening means on each bolt, for loosely holding each gripping portion to the main step portion. An alternative to this preferable loose assembly, the gripping portions may be put on after the rope is put in place, but this is more awkward and time consuming.

For spreader steps, a special bracket is employed so that the outboard portions may be evenly coated with elastomer on all sides, when molding.

Thus, when the ladder is assembled, preferably a series of steps is laid out in a jig, and two ropes are threaded through both rope-receiving openings of all the steps. (The two ropes may be a single rope looped at the bottom of the ladder.) Then the bolts of the first or bottom step are fully tightened on the ropes. Next, the ropes are all placed in tension to test the firmness of the gripping of the rope, using up to two tons of pull. The tension thins the rope down, and while the ropes are still under this tension and therefore are at their smallest cross-sectional dimension, the bolts in all the other steps are tightened in place, so that at each step the two pairs of ropes are seized tightly by the clamping action of main step portion and the two gripping portions, with the projections of the body into the rope-receiving openings engaging and digging into the ropes. Only when the connection at all steps has been fully tightened, is the tension on the ropes released. The somewhat relaxed ropes tend to enlarge a little, making the gripping action even more effective.

BRIEF DESCRIPTION OF THE DRAWINGS

In the drawings:

FIG. 1 is an isometric view of a portion of a rope ladder embodying the principles of the invention and showing three steps, including one spreader step, embodying the principles of the invention and attached to two pairs of ropes.

FIG. 2 is a top plan view of the reinforcing metal frame for the step, shown before molding, with portions broken away.

FIG. 3 is a bottom view of the frame of FIG. 1, with portions broken away.

FIG. 4 is a top plan view of the step, showing at the left the step after molding and cutting and at the right the step partially reassembled.

FIG. 5 is a view in section taken along the line 5—5 in FIG. 4, the rope being shown in broken lines.

FIG. 6 is a view in section taken along the line 6—6 in FIG. 5 of the two ropes being shown in broken lines.

FIG. 7 is a view in section of a mold for the step, the view of the step being taken along the line 7—7 in FIG. 5.

FIG. 8 is a view in section taken along the line 8—8 in FIG. 5, showing the step after molding.

FIG. 10 is a view in perspective of a bracket used to space and support the spreader step frame in the mold, a portion of that frame being shown in broken lines.

FIG. 13 is a view in front elevation of an assembly jig for the ladder, with steps in place. The jig is partially broken away.

FIG. 14 is a view in side elevation of the jig of FIG. 13.

DETAILED DESCRIPTION OF THE INVENTION

The rope ladder 20

Figure 9:
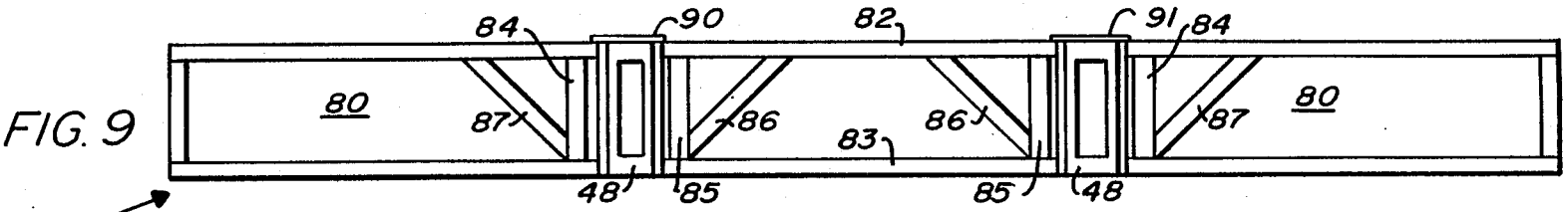
FIG. 9 is a top plan view of a spreader step frame.

FIG. 1 shows a portion of a rope ladder 20 embodying the invention. The ladder 20 is especially useful as a pilot's ladder for boarding and leaving ships, but the ladder 20 may be a debarkation ladder or used otherwise. The ladder 20 comprises four ropes distributed as two pairs of ropes 21, 22 and 23, 24, one pair at each side of the ladder 20. The ladder 20 further comprises a series of steps 25 and, at intervals usually as prescribed by the United States Coast Guard, a series of elongated spreader steps 26, which extend out well beyond the rope pairs 21, 22 and 23, 24, and help to keep the ladder 20 from turning or twisting relative to the side of a ship. The spreader steps 26 have a central portion 27 like the step 25 and have outboard portions 28 at each end, similar to what is shown in U.S. Pat. No. 4,554,996. However, this invention also includes improvements in the spreader step 26, discussed later. For a pilot's ladder 20, the steps 25 are about twenty inches long, about five inches wide, and about an inch thick at the tread.

The steps 25 (FIGS. 1 to 6 and 11)

In the present invention, as shown in FIG. 4, each step 25 comprises, a main step portion 30 and two gripping portions 31 and 32, preferably cut out of the step 25.

Each step 25 comprises a metal frame 33 (See FIGS. 2 and 3) about which is molded a body 34, preferably of a suitable hard elastomer, such as a hard synthetic rubber composition. The body 34 has some flexibility but is not readily bent or flexed by hand. The body 34 has an upper tread surface 35 (See FIGS. 1 and 4), which is shaped and surfaced to reduce the likelihood of skidding or sliding thereon. The non-skid aspect of the upper surface 35 may be enhanced by first spraying a suitable paint of a type which will adhere to that surface, then adding to it grit and then coating it with paint again so as to bond the grit to the paint and, through it, to the step 25. Each step 35 also has a lower surface 36 (FIG. 1).

At each end of each step 25 are two integral raised molded collar portions, an upper collar 37 and a lower collar 38, (FIGS. 2 and 3). The integral collar portions 37 and 38 extend up from the step's top surface 35 and down from the step's lower surface 36 (FIGS. 5 and 6). Each integral collar portion 37, 38 encompasses a rope-receiving opening 39 which extends through the step 25 in between the collar portions 37 and 38. The rope-receiving openings 39 have vertical transverse and end walls 40. The opening 39 is barely large enough to accommodate its two ropes, and the body 34 is provided with wedge-like projections 41 extending out into the openings 39.

The frame 33, which can be seen in FIGS. 2 and 3, preferably is made largely of thin but strong lightweight metal alloy tubing, preferably square in cross-section and preferably a steel alloy. There may be two longitudinal tubes 42 and 43; spaced inboard from each end and preferably on both sides of the rope there may be transverse tubes 44 and 45 that are each welded to the tubes 42 and 43. Diagonally-extending tubes 46 and 47 may be used to strengthen the structure with one end of each tube 42, 43 welded to a transverse tube 45 near where they meet the longitudinal tube 43, the other end being welded to the other longitudinal tube 42.

At each end of the frame 33, there is preferably an upper metal bracket 48 and a lower metal bracket 49 welded to the upper and outer surfaces, respectively, of the longitudinal tubes 42 and 43, each end having a plate portion 50. Each bracket 48, 49 may have flanges 51 and 52 that are welded to the tubes 42 and 43 and are connected to plate portion 50 by vertical portions 53 and 54. The two plate portions 50 surround and define a rectangular opening 55 corresponding to the through opening 39, the metal therearound strengthening that portion of the step 25.

Horizontal transverse bolt openings 60 and 61 are provided near each end of the step 25, one on each side of each rope-receiving opening 39. For each bolt opening 60, 61 there is a bolt 62 (preferably of stainless steel) and a nut 63, or other fastening means, and a pair of cylindrical nylon tubes 64 and 65, each having a head 66. The bolt openings 60 and 61 include openings 67 drilled before the molding operation though the horizontal frame members 42 and 43. At each end of the openings 60 and 61, a countersunk recess 68 may be provided to receive both the head 66 of the nylon tube 64 or 65 and the head 69 of the bolt 62 or the nut 63. The recesses 68 may be provided during molding. As shown in FIG. 7, a slug bolt 70, having a thick, round, slotted slug head 71 is inserted over and through the nylon tubes 64 and 65 before molding, and are fastened by a slug nut 72. After molding, the slug bolt 70 is removed.

The molded step 25 is then cut along lines 73 and 74 to provide the main step portion 26 and the two gripping portions 31 and 32. The cut 73, 74 opens one end of each rope-receiving opening 39 but only one end. Moreover, each portion 31 and 32 has a portion 43*a* or 43*b* of the tube 43 and a portion 50*a* or 50*b* or the plate 50, as well as a portion 34*a* or 34*b* of the surrounding body 34. These gripping portions 31 and 32 are secured to the main step portion 26 by the bolts 62 and nuts 63, either after installing the ropes 21, 22 and 23, 24, or, preferably, they are loosely attached before the ropes are installed. The bolts 62 are inserted through the nylon tubes 64 and 65 and are fastened by the nuts 63. The nylon tubes 64 and 65 prevent bimetallic corrosion of the stainless steel bolts 62 and of the lightweight metal alloy frame 33, for the ladders 20 often encounter salt water.

Assembly of the Ladder 20

Figure 11:
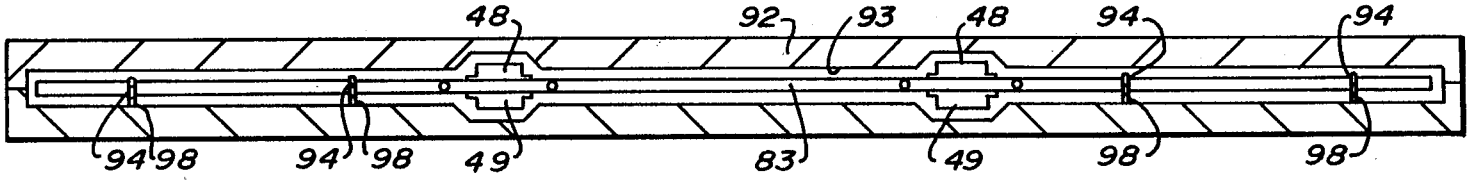
FIG. 11 is a view in section of the mold containing the spreader step of FIG. 9 with its brackets, just prior to adding the elastomer and molding it.

Thus, with the gripping portions 31 and 32 only loosely in place, the loosely assembled steps are installed in a jig 75, each step being set in between two supporting members 76 and 77, as shown in FIGS. 10 and 11. The ropes 21, 22 and 23, 24 are threaded through the openings 39. Each pair of ropes 21, 22 and 23, 24 may actually be a single rope looped at one end, where it engages the bottom step 25, this structure is preferred for pilot ladders. For debarkation ladders, there may be a thimble or clamp at the lower end of the rope. When all the ropes have been threaded through all of the openings 39 of all the steps 25 and 26, the bolts 62 for the bottom step are fully tightened. After that the ropes 21, 22, 23, 24 are stretched and tensed, preferably with a force of about two tons. This force tests the correct installation of the bottom step 25. Then, the nuts 63 are fully tightened on all the bolts 62, clamping the gripping portions 31 and 32 very tightly against the ropes 21, 22, 23, and 24, so that the projections 41 actually dig into the ropes.

Only when the gripping portions 31 and 32 are clamped very tightly in place, is the tension on the ropes 21, 22, 23, and 24 relaxed. Tension tends to reduce the diameter and circumference of each rope, and relaxation lets the rope re-enlarge somewhat, thereby increasing the gripping force on the ropes.

Thus, the ladder steps 25 are held tightly on the pairs of ropes 21, 22, and 23, 24, without any member passing between the ropes of either pair.

The spreader steps 26

The elongated spreader steps 26 are generally like the steps 25, but they have outboard portions 28 on each side of a central portion 27. The central portion 27 is just like the step 25 and has the gripping portions 31 and 32 cut out therefrom. The outboard portions are hollow with openings 80 that provide handholds. As shown in FIG. 9 each spreader step 26 has a unitary frame 81, with two very long longitudinal tubes 82 and 83 like the tubes 42 and 43 welded to transverse end tubes 84 and to intermediate cross tubes 85 that correspond in position to the transverse tubes 44 and 45. Diagonal tubes 86 are positioned exactly as the members 46 of the step 25, and brackets 48 and 49 are mounted in the rope area just as before. Additional diagonal braces 87 are preferably employed outboard of the members 46 and 47 and symmetrical to the braces 86 with respect to the brackets 48 or 49. Further strength is provided at the weak juncture area of the frame members 40, 41 with the members 130 and 131, by steel plates 90 and 91 welded firmly to the outside surface of the frame members 82 and 83 at both ends.

Figure 12:
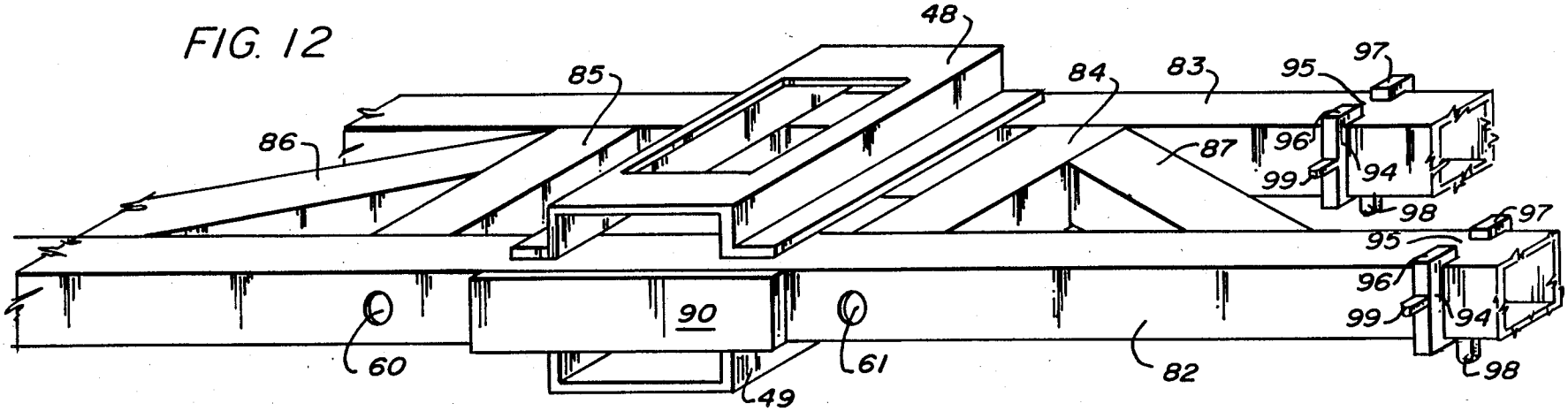
FIG. 12 is an enlarged fragmentary view in perspective of a portion of the spreader step frame with the mold-spacing brackets in place, before molding.

The spreader steps 26 are completed by placing the frame 81 in a mold 92 having a mold cavity 93, shown in FIG. 11, to coat substantially the entire frame 81 with the elastomer of the body 34. To space the frame 81 from the bottom and side walls of the mold cavity 93, a special bracket 94 is provided. This bracket 94 is shaped as a broken square, as shown in FIG. 10 where the frame 81 is shown in its upright position rather than inverted as shown in FIGS. 11 and 12, as the frame 81 is during molding. Thus, the portion uppermost during molding has a gap 95 between two short segments 96 and 97 that provide flexibility and ease installation spacing at the bottom of the mold cavity 93 is provided by a spacer knob 98, while spacing at the sides is provided by two identical spacer knobs 99. Thus, during molding the frame 81 has its outboard portions coated with elastomer to reduce corrosion during use, and the non-metallic plastic clip or bracket 94 remains in place.

The central portion 27 that corresponds to the step 25 is identical to that portion; only the outboard portions 8 are hollow and provide handholds. The handhold structure saves material and lightens the step 26, while increasing its effectiveness.

The elongated spreader steps 26 are typically about seventy inches long, and the handhold openings about two inches by eight inches when there are two openings on each side of each central portion 27. For a forty-foot ladder, there are usually four of the elongated or spreader steps 26. Their assembly into the ladder 20 is no different from that of the steps 25.

In addition to serving their usual functions, the spreader steps 26 solve several problems. Conventional wooden spreaders tend to catch the wind, and when they do, they tend to cause the ladder to twist or spin, thereby making ascent or descent dangerous, if not impossible. The openings 80 let the wind pass through the outboard portions 28, and greatly reduce the wind resistance, thereby significantly increasing the ladder's safety. Furthermore, as indicated the rims around the openings 80, serve as handholds when needed, as on windy days and nights, thereby adding another safety feature. Beyond all this, the openings 80 lighten the weight of the ladder 20 considerably, and width is always a consideration for pilot ladders. On a forty-foot ladder 20 with four spreader steps 26, the open area is about $2'' \times 8'' \times 4 \times 4 = 256$ square inches, and at one inch thick, this open area is equivalent to reducing the weight by the weight of a $4'' \times 1''$ board about five and one-half feet long, this open area is equivalent to reducing the weight by the weight of a $4'' \times 1''$ board about five and one-half feet long.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A step for a rope ladder of the type having a series of ladder steps and two spaced-apart pairs of ropes, said step including in combination:

a metal step frame having a pair of longitudinal members with upper and lower surfaces and joined by shorter crossing members, and having at each end a pair of aligned metal brackets bridging across the pair of longitudinal members, one on said upper surface and one on said lower surface, each bracket defining a generally rectangular opening, aligned with that of the other of said pair of brackets, a molded hard elastomer body molded around said frame and having a pair of integral collar portions at each end, each molded around a said bracket, said body having a rope-receiving opening through each collar portion and the body therebetween and in line with the rectangular openings through said brackets, each said rope-receiving opening being shaped and sized for closely confining said pair of ropes, said body and said frame defining a said step, said step having a pair of horizontal transverse openings through said step parallel to each other on each side of each said rope-receiving opening, said transverse openings extending transversely through said longitudinal members, said step being cut on one side only to provide a main step portion and two separate gripping portions, one for each said rope-receiving opening, each gripping portion incorporating a portion of one said longitudinal frame member, a portion of each said bracket of one pair thereof, and a portion of said body, each said gripping portion also including a portion of each said transverse opening, two nylon tubes extending into each said transverse opening, one for said main step portion at the end opposite said gripping portion and one for each said gripping portion, said tube extending through said longitudinal frame members, a bolt extending through said two tubes and between them, and fastening means for each said bolt, for clamping each said gripping portions toward said main step portion when a said pair of said ropes has been inserted in each said rope-receiving opening.

2. The step of claim 1 wherein each said body has a series of rope-engaging projections extending into said rope-engaging opening.

3. The step of claim 1 as a spreader step, having a central portion like said step but with a pair of outboard portions that include extended portions of said longitudinal frame members joined at their outboard ends by transverse frame members, said outboard portions having openings between said extended portions to provide handholds, lightness, and wind passages therethrough, said outboard portion also having a pair of steel plates, each welded to the outside edge of each said longitudinal frame members from inboard of each said rope-engaging opening to the adjacent portion of said extended portions thereof, and diagonal portions extending from one said longitudinal member to the other outboard of said rope-engaging opening but adjacent thereto.

4. The spreader step of claim 3 wherein said outboard portions of the frame are evenly coated on all sides with elastomer.

5. A rope ladder including in combination:

a series of of ladder steps and two spaced-apart pairs of ropes, each said step comprising a metal step frame having a pair of longitudinal members with upper and lower surfaces and joined by shorter crossing members, and having at each end a pair of aligned metal brackets bridging across the pair of longitudinal members, one bracket on said upper surface and one bracket on said lower surface, each said bracket defining a generally rectangular opening, aligned with that of the other bracket and a molded hard elastomer body molded around said frame and having a pair of integral collar portions at each end, each molded around a said bracket, said body having a rope-receiving opening through each collar portion and the body therebetween, in line with the rectangular openings through said brackets, each said rope-receiving opening being shaped and sized for closely confining said pair of ropes, each said step having a pair of horizontal transverse openings through said step parallel to each other on each side of each said rope-receiving opening, said transverse openings extending transversely through said longitudinal members, each said step being cut on one side only to leave a main step portion and provide two separate gripping portions, one for each said rope-receiving opening, each gripping portion incorporating a portion of one said longitudinal frame member, a portion of each said bracket of a said pair of brackets, and a portion of said body, each said gripping portions also including a portion of each said transverse opening, two nylon tubes extending through each said transverse opening, one from the uncut edge of said main step portion and one from the edge of said gripping portions, the latter said tube extending through and past said cut rectangular frame member, a bolt extending through the two aligned nylon tubes and the transverse opening between them, and fastening means for each said bolt, for clamping each said gripping portion toward said main step portion with a said pair of said ropes in each said rope-receiving opening and for clamping said ropes tightly in place relative to said step.

6. The ladder of claim 5 wherein said body has a series of projections extending into said rope-engaging openings, engaging and tightly grasping said ropes.

7. The step claimed in claim 5 as a spreader step having a central portion like said step and with a pair of outboard portions that include extended portions of said longitudinal frame members joined at their outboard ends by transverse frame members, said outboard portions having openings between said extended portions to provide handholds, lightness, and wind passages therethrough, said outboard portion also having a pair of steel plates, each welded to the outside edge of each said longitudinal frame member from inboard of each said rope-engaging opening to the adjacent portion of said extended portions thereof and a pair of diagonal frame members just outboard of said central portion, extending from one said longitudinal frame member to the other.

8. The spreader step of claim 7 wherein the outboard frame portions are coated evenly on all sides with elastomer.

9. A method for making a rope ladder of the type having a series of ladder steps and two spaced-apart pairs of ropes, wherein each step comprises a metal step frame having a pair of longitudinal members with upper and lower surfaces and joined by shorter crossing members, and having at each end a pair of aligned metal brackets bridging across the pair of longitudinal members, one on said upper surface and one on said lower surface, defining a generally rectangular opening, aligned with that of the other of said pair of brackets, comprising the steps of:

boring a set of aligned horizontal opening transversely through said longitudinal members adjacent to a said bracket and inboard thereof, molding a one-piece hard elastomer body around said frame to provide a pair of integral collar portions at each end, each being molded around a said bracket, while molding in said body a rope-receiving opening through each collar portion and the body therebetween, in line with the rectangular openings through said brackets, each said rope-receiving opening being shaped and sized during said molding step for closely confining said pair of ropes, each said step being provided during said molding with a pair of horizontal transverse openings through said step parallel to each other and aligned with the horizontal openings extending transversely through said longitudinal members, cutting said step on one side only to provide a main step portion and two separate gripping portions, one for each said rope-receiving opening, each said gripping portion incorporating a portion of one said longitudinal frame member, a portion of each of one said pair of brackets, and a portion of said body, each said gripping portion also including a portion of each said transverse opening, passing a bolt through each said bolt opening of both said main step portion and said gripping portions of each said step and loosely securing fastening means on each said bolt, threading a said pair of said ropes through the rope-engaging openings on each end of a plurality of said steps, and tightening said fastening means fully so as to clamp each said gripping portion to each said main step portion and to said ropes in each said rope-receiving opening.

10. The method of claim 9 wherein, after said boring step and before said molding step, there is the step of inserting a nylon tube into each end of each said horizontal opening through said longitudinal frame members, said molding step thereby incorporating said tubes into said step, an said passing step then comprises passing said bolt through the pair of aligned nylon tubes.

11. The method of claim 9 wherein after said inserting step and before said molding step there are the steps of applying a slug bolt through each aligned pair of nylon tubes and securing it there by a slug nut, and removing said slug bolt and slug nut after said molding step and before said cutting step.

12. The method of claim 9 as applied to a spreader step having a central frame portion as stated in claim 9 and a pair of outboard frame portions, comprising, prior to said molding step, installing spacer brackets around portions of said outboard frame with knob portions engaging the sides and bottom of the mold cavity to space said outboard frame portions from the mold, and in said molding step covering said outboard frame portions and said brackets with elastomer.

13. The method of claim 9 wherein after said threading step and before said tightening step is applied to any but said bottom step, there are the steps of exerting tension on all said ropes with a strong force, so as to stretch them out and reduce their diameters and circumferences, then after said tightening step has been applied to all said steps, releasing the tension on said ropes.

* * * * *